US006978821B2

(12) United States Patent
Welfonder

(10) Patent No.: US 6,978,821 B2
(45) Date of Patent: Dec. 27, 2005

(54) RAIL FOR A FABRIC BLIND AND METHOD OF ATTACHING RAIL TO A FABRIC

(75) Inventor: Konrad Welfonder, Bremerhaven (DE)

(73) Assignee: Hunter Douglas Industries BV, El Rotterdam (NL)

( * ) Notice: Subject to any disclaimer, the term of this patent is extended or adjusted under 35 U.S.C. 154(b) by 0 days.

(21) Appl. No.: 10/624,425

(22) Filed: Jul. 21, 2003

(65) Prior Publication Data

US 2004/0016519 A1 Jan. 29, 2004

(30) Foreign Application Priority Data

Jul. 22, 2002 (EP) ..... 02077975

(51) Int. Cl.[7] ..... E06B 9/30

(52) U.S. Cl. ..... 160/178.1 R; 160/236; 160/238

(58) Field of Search ..... 160/178.1 R, 236, 160/238, 23.1, 173 R, 122, 241, 395, 290.1, 160/120, 265, 291; 29/235; 52/741; 428/35.8

(56) References Cited

U.S. PATENT DOCUMENTS

| | | | | |
|---|---|---|---|---|
| 3,018,824 A | | 1/1962 | Anderson et al. | 160/394 |
| 4,344,474 A | * | 8/1982 | Berman | 160/121.1 |
| 4,393,915 A | | 7/1983 | Olson | |
| 4,452,294 A | | 6/1984 | Fukuchi | |
| 5,049,424 A | * | 9/1991 | Carden et al. | 428/35.8 |
| 5,127,143 A | | 7/1992 | Urlacher | 29/235 |
| 5,149,918 A | | 9/1992 | Kozik et al. | 178/18 |
| 5,647,421 A | * | 7/1997 | Hoffmann et al. | 160/120 |
| 6,598,651 B2 | * | 7/2003 | Ehrenberger et al. | 160/238 |

FOREIGN PATENT DOCUMENTS

| | | | | |
|---|---|---|---|---|
| GB | 1191532 | | 5/1970 | |
| GB | 1366961 | | 9/1974 | |
| GB | 1462613 | | 1/1977 | |
| JP | 63-24786 | | 11/1994 | |
| JP | 121960 | * | 5/1997 | 160/178.1 R |
| WO | WO 84/04559 | | 11/1984 | |

* cited by examiner

*Primary Examiner*—Bruce A. Lev
(74) *Attorney, Agent, or Firm*—Dorsey & Whitney LLP

(57) ABSTRACT

An elongate hollow rail for a fabric covering for an architectural opening, such as a bottom rail for a fabric roller blind or a top or bottom rail for a roman shade, having an upper portion with a lengthwise upper opening in the top of the rail and being characterized by a pair of lengthwise upper locking shoulders in the interior of the upper portion on walls on opposite widthwise sides of the upper opening, the upper locking shoulders being wedge-shaped and pointing inwardly of the upper portion and away from the upper opening, and the wall on a first widthwise side of the bottom rail extending above the wall on the opposite second widthwise side of the bottom rail about the openings and a method for attaching a fabric to a locking shoulder within an elongate hollow rail as described.

23 Claims, 5 Drawing Sheets

RAIL FOR A FABRIC BLIND AND METHOD OF ATTACHING RAIL TO A FABRIC

CROSS REFERENCE TO RELATED APPLICATIONS

This application claims priority to European Application No. 02077975.7, filed 22 Jul. 2002, which is hereby incorporated by reference as if fully disclosed herein.

BACKGROUND OF THE INVENTION

1. Field of the Invention

This invention relates to a hollow rail or bar for a fabric covering for an architectural opening, such as a bottom rail for a fabric roller blind or a top or bottom rail for a roman shade, and a method for attaching the fabric of the covering to the rail.

2. Description of the Relevant Art

Profiles for elongate hollow bottom rails for fabric window coverings are known, for example, from: GB 1,191,532, GB 1,366,961, GB 1,462,613 and JP 63-24786. Often, such bottom rails are cut from a length of hollow, extruded plastic or hollow, roll formed or extruded metal and are of round, elliptical or generally pear shaped cross-section. The interior of such a bottom rail often has had a continuous intermediate widthwise cross web, extending between the rail's walls on its opposite widthwise sides and dividing the inside of the rail's profile into upper and lower portions extending along the length of the rail. The upper portion has usually had a lengthwise opening or slot in the top of the rail, and in some window coverings, the lower portion has also had a lengthwise opening in the bottom of the rail. A marginal end of the fabric of a window covering has generally been inserted in such a lengthwise opening in a bottom rail to attach the fabric and rail together.

One method of attaching a fabric to such a rail has involved providing the marginal end of the fabric with a stiffening (e.g., stiff plastic) member that extends along the length of the rail. The marginal end of the fabric with the stiffening member has been inserted into an end of the rail, above or below the rail's cross web, and then slid lengthwise along the cross web as the remainder of the fabric, extending through the rail's upper or lower lengthwise opening, is slid along the rail's lengthwise opening. The stiffening member has held the marginal end of the fabric within the upper or lower portion of the rail, into which the stiffening member has been inserted, and prevented the marginal end of the fabric from subsequently being pulled out of the rail, through its adjacent lengthwise opening in the rail's upper or lower portion. In a rail where the width of the stiffening member has been smaller than the width of the adjacent lengthwise opening in the rail's upper or lower portion, the interior of the upper and/or lower portion has been provided with a lengthwise locking shoulder, which can engage the stiffening member to prevent it from being pulled out of the adjacent lengthwise opening.

Another method for attaching the fabric and rail, as described in U.S. Pat. No. 3,018,824, has involved providing clips within a lengthwise opening or groove in the rail's upper or lower portion. In this method, a creasing device has been used for inserting the fabric into the lengthwise opening and a clip driver has been used for subsequently inserting locking clips into the opening. The creasing device has used an elongated blade to push the fabric into the opening in a single operation. The clip driver has used a wheel to push the fabric into the opening as the wheel is rolled along the length of the opening.

Yet another method for attaching a screen fabric to each side of a frame, as described in U.S. Pat. No. 5,127,143, has providing a spline in a shallow lengthwise groove in each side of the frame. In this method, a wheel has been rolled over both the screen fabric and the spline, lain atop the groove, to insert the screen fabric and spline into the groove.

SUMMARY OF THE INVENTION

In accordance with this invention, an elongate hollow rail for a fabric covering for an architectural opening, such as a bottom rail for a fabric roller blind, is provided, having an upper portion with a lengthwise upper opening in the top of the rail and being characterized by:

- a pair of lengthwise upper locking shoulders in the interior of the upper portion on walls on opposite widthwise sides of the upper opening; and/or
- the upper locking shoulders being wedge-shaped and pointing inwardly of the upper portion and away from the upper opening; and/or
- the wall on a first widthwise side of the bottom rail extending above the wall on the opposite second widthwise side of the bottom rail about the opening.

The rail can also have a lower portion with a lengthwise lower opening in the bottom of the rail and be characterized by:

- a pair of lengthwise lower locking shoulders in the interior of the lower portion on walls on opposite widthwise sides of the lower opening; and/or
- the lower locking shoulders being wedge-shaped and pointing inwardly of the lower portion and away from the lower opening; and/or
- the wall on the second widthwise side of the bottom rail extending below the wall on the first widthwise side of the bottom rail about the lower opening.

The rail can further have a continuous intermediate widthwise cross web, dividing the interior of the rail's profile into upper and lower portions and be characterized by:

- the cross web being tilted widthwise; and
- opposite widthwise sides of the cross web being parallel but not coplanar.

Also in accordance with this invention, a method is provided for attaching a fabric to a locking shoulder within an elongate hollow rail for a fabric covering for an architectural opening having a lengthwise upper opening in the top of the rail, by the steps of:

- securing the rail to a stationary support structure with its lengthwise upper opening facing upwards;
- overlaying the rail and its upper opening and walls with a fabric having a stiff straight marginal edge, so that the stiff marginal edge lies parallel and adjacent to a wall on a widthwise side of the rail and the remainder of the fabric extends widthwise away from the stiff marginal edge and the rail and its other wall;
- pushing the fabric into the upper opening by rolling the circumferential edge of a fabric inserting wheel against the top of the fabric and lengthwise along, and inwardly of, the upper opening while allowing the stiff marginal edge to move widthwise towards the upper opening but preventing the remainder of the fabric from moving widthwise towards the upper opening; and then
- pushing the stiff marginal edge into the upper opening so that the stiff marginal edge engages the locking shoulder by again rolling the circumferential edge of the fabric inserting wheel against the top of the fabric and lengthwise along, and inwardly of, the upper opening while preventing the remainder of the fabric from moving widthwise towards the upper opening.

This method is quick, efficient, and easy to use, and can be readily automated, particularly with the elongate hollow rail of this invention.

The method can also be used to cover one wall of the rail with the fabric where the bottom of the rail has a lengthwise lower opening. This can be done by:

rotating the rail in a direction such that the stiff marginal edge of the fabric is not disengaged from the locking shoulder and until the lengthwise lower opening faces upwards, the fabric covers the one wall and overlies the rail and its lower opening and the other wall, and the remainder of the fabric extends widthwise away from the rail and the other wall; and then pushing the fabric into the lower opening to form a first fold in the lower portion by rolling the circumferential edge of the fabric inserting wheel against the top of the fabric and lengthwise along, and inwardly of, the lower opening while allowing the remainder of the fabric to move widthwise towards the lower opening; and then inserting, in a lengthwise direction, a elongate first spline into the first fold.

The method can also be used to cover the other wall of the rail with the fabric by:

again rotating the rail in a direction such that the stiff marginal edge of the fabric is not disengaged from the locking shoulder and until its lengthwise upper opening faces upwards, the fabric covers the other wall and overlies the rail and its upper opening and the one wall, and the remainder of the fabric extends widthwise away from the rail and the one wall; and then pushing the fabric into the upper opening to form a second fold in the upper portion by rolling the circumferential edge of the fabric inserting wheel against the top of the fabric and lengthwise along, and inwardly of, the upper opening while allowing the remainder of the fabric to move widthwise towards the upper opening; and then inserting, in a lengthwise direction, a elongate second spline into the second fold.

The method of this invention preferably involves repeatedly rolling the circumferential edge of the fabric inserting wheel along, and inwardly of, an opening in an upper or lower portion of the rail, especially repeatedly rolling the circumferential edge of the fabric inserting wheel in both lengthwise directions. The method can also involve attaching a roller blind or roman shade fabric to an upper opening of the rail and attaching a valance fabric to a bottom opening of the rail.

Also in accordance with this invention, an apparatus is provided for attaching a fabric to an elongate hollow rail for a fabric covering for an architectural opening, comprising means for carrying out the steps of the method of the invention.

Further aspects of the invention will be apparent from the detailed description below of particular embodiments and the drawing thereof.

DESCRIPTION OF THE PREFERRED EMBODIMENTS

Figure 1A:
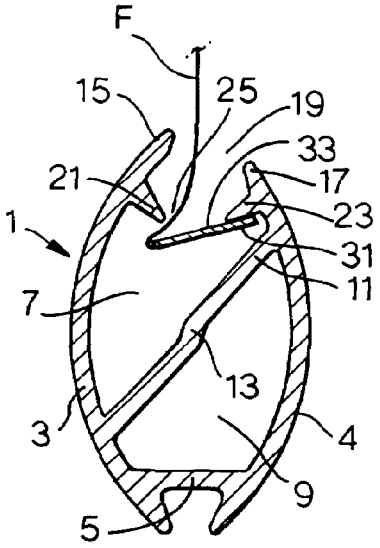
FIG. 1A is a widthwise cross-section of a bottom rail (e.g., of a fabric roller blind) of this invention, showing the profile of the rail with only an upper lengthwise opening; a blind fabric is shown as being attached to an upper portion of the rail by only the stiff marginal edge of the fabric locked under a locking shoulder on a widthwise wall of the rail.
Figure 1B:
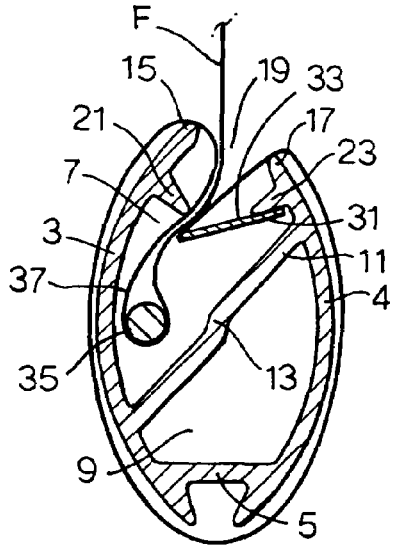
FIG. 1B is a widthwise cross-section of the bottom rail of FIG. 1A; the fabric is shown as being secured to the upper portion of the rail by a spline, inserted after inserting the stiff marginal edge of the fabric and after covering the widthwise walls of the rail.

FIGS. 1A and 1B show the widthwise profile of an elongated bottom rail 1 of an otherwise conventional roller blind (not shown). The bottom rail 1 has a front wall 3 and a rear wall 4, on opposite widthwise sides of the rail, and a closed bottom wall 5. Within the bottom rail 1 is a lengthwise internal channel 6 which is divided into an upper portion 7 and a lower portion 9 by a continuous lengthwise cross web or cross member 11. The cross web 11 is slanted downwardly widthwise from the rear wall 4 to the front Wall 3 and preferably includes a small vertically-extending dog-leg 13 in its middle, so that opposite widthwise sides of the cross web 11 are parallel but not coplanar. The reason for the cross web 11 being slanted is so that the rail 1 can be of minimum size but still have a sufficiently large upper portion 7 to hold securely a blind fabric F. However, the rail's closed bottom 5 makes the use of the cross web 11, to hold the rail together, preferred but not necessary. Moreover, the cross web 11, if used, need not be slanted if the rail 1 is made larger. Nevertheless, the use of internal strengthening ribs on the rail's walls 3,4 may well be desirable if the cross web is not used and/or the rail is made larger.

The top 15 of the front wall 3 preferably extends over the top 17 of the rear wall 4. This shields a lengthwise upper opening or slot 19, in the top of the upper portion 7 between the two opposite walls 3,4 of the rail 1, from view from the front wall 3. The upper opening 19 extends lengthwise substantially the full length of the rail 1 and opens into the upper portion 7 of the channel 6, so that the entire length of the blind fabric F can be inserted into the upper portion 7 of the rail through the upper opening 19.

Two fabric upper locking shoulders 21, 23 preferably extend lengthwise along the inner surface of the front wall 3 and rear wall 4, respectively, in the upper portion 7 of the rail's channel 6 and are downwardly slanted widthwise towards the middle of the rail. Between these two upper locking shoulders 21, 23 is a gap 25 having a width that allows a widthwise straight stiff marginal edge portion 31 of the length of blind fabric F to be pushed, from the upper opening 19, downwardly past the upper locking shoulders. Preferably, the upper locking shoulders are wedge-shaped and point inwardly of the upper portion 7 and away from the upper opening 19.

FIGS. 1A and 1B also show the marginal edge portion 31 of the blind fabric F inserted into the upper portion 7 of the rail 1, so that the length of the fabric F extends lengthwise in the rail and the width of the marginal edge portion 31 is between the rear locking shoulder 23 and the cross web 11. The marginal edge portion 31 of the fabric F is stiff but flexible and preferably resilient, but it is not rigid. The marginal edge portion 31 is preferably stiffened with a piece of plastic or the like 33, bonded or sewn to the fabric, but can also be stiffened by treatment with a stiffening agent. The marginal edge portion 31 is also preferably slightly wider than the gap 25 between the two upper locking shoulders 21, 23. Furthermore, the width of the marginal edge portion 31 is preferably somewhat greater than the width of the rear locking shoulder 23. These features serve individually and collectively to help keep the marginal edge portion 31 below, and engaged by, one of the upper locking shoulders 21,23 (i.e., between the rear locking shoulder 23 and the cross web 11 in FIG. 1A) once the marginal edge portion 31 has been pushed downwardly past the upper locking shoulders. However, a single upper locking shoulder could also be used in the rail 1, provided the widthwise gap between the one locking shoulder, on one wall of the rail, and the wall on the opposite widthwise side of the rail is smaller than the width of the stiff marginal edge portion 31 of the fabric, so that the marginal edge portion cannot be easily pulled out of the rail.

The width of the stiff marginal edge portion 31 of the blind fabric F and of the gap 25 between the two upper locking shoulders 21, 23 is not considered critical, so long as the marginal edge portion 31 is somewhat wider than the gap 25. In this regard, a width of about 3 to 9 mm, particularly about 6 mm, for the marginal edge portion 31 and a width of about 2.5 to 6 mm, particularly about 4 mm, for the gap 25 are preferred.

FIG. 1B shows the same rail 1 and blind fabric F as FIG. 1A, but the fabric completely surrounds the rail and is held by its stiff marginal edge portion 31, that is between the rear upper locking shoulder 23 and the cross web 11 and engages the underside of the rear upper locking shoulder 23, and additionally by an upper lengthwise spline 35 below the upper front locking shoulder 21 (between the upper front locking shoulder and the cross web 11). The upper spline lies within an upper lengthwise fold 37 of the blind fabric F which is inserted into the upper portion 7 of the channel 6 through the upper opening 19 and downwardly past the gap 25 between the upper locking shoulders. The upper spline 35 locks against the fabric's stiff marginal edge portion 31 and the upper locking shoulders 21,23 beneath the upward facing opening 19, to prevent the upper blind fabric fold 37 from being pulled out of the upper opening. For this reason, the upper spline 35 preferably has a cross-section which exceeds the width of the gap 25, and the upper spline is preferably inserted longitudinally into the upper blind fabric fold 37 from an open end of the rail (not shown).

Figure 3A:
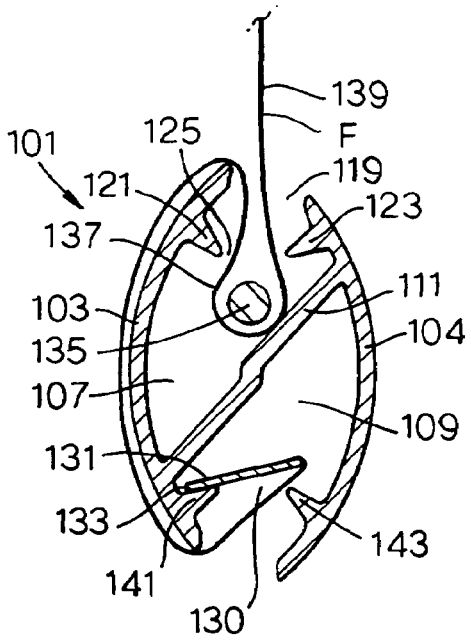
Figure 3B:
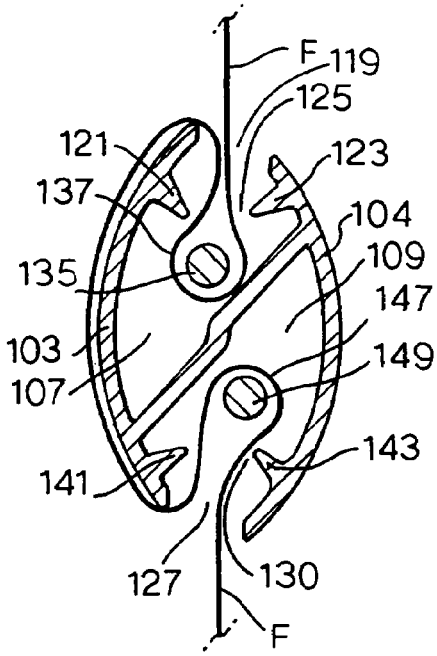
Figure 4:
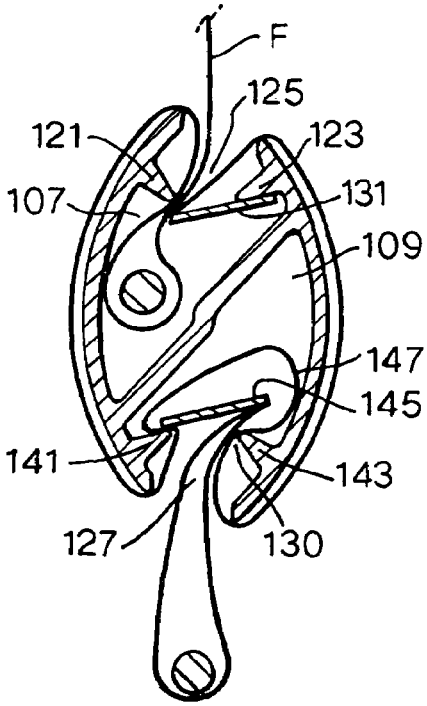

FIGS. 2–4 show another embodiment 101 of the rail of this invention, with like parts being referred to with like reference numerals greater by "100". The rail 101 in FIGS. 2–4 has a front wall 103, a rear wall 104, lengthwise upper and lower portion 107, 109 of an inner channel 106 and a continuous lengthwise cross web 111 which substantially holds the front and rear walls together. The cross web 111 is slanted downwardly widthwise from the rear wall 104 to the front wall 103 and preferably includes a small vertically-extending dog-leg 113 in its middle The top 115 of the front wall 103 extends over the top 117 of the rear wall 104, shielding the upper opening 119 from view. Instead of a bottom wall (5 in FIG. 1), at the bottom of the lower portion 109 of the rail 101 is a lower opening 127. The bottom 128 of the rear wall 104 extends below the bottom 129 of front wall 103 to shield the lower opening 127 from view from the rear wall 104.

The rail 101 has two upper fabric locking shoulders 121,123 and two corresponding lower fabric locking shoulders 141, 143. The lower locking shoulders 141, 143 extend lengthwise along the inner surface of the front wall 103 and rear wall 104, respectively, in the lower portion 119 of the rail 101 and slant towards the middle of the rail. Between the two lower locking shoulders 141, 143 is a bottom gap 130 that corresponds to the gap 125 between the upper locking shoulders and has a width that allows a widthwise marginal edge portion 131 of the length of a blind fabric F to be pushed, from the lower opening 127, downwardly past the lower locking shoulders. Preferably, the lower locking shoulders 141, 143 are wedge-shaped and point inwardly of the lower portion 109 and away from the lower opening 127.

Figure 2A:
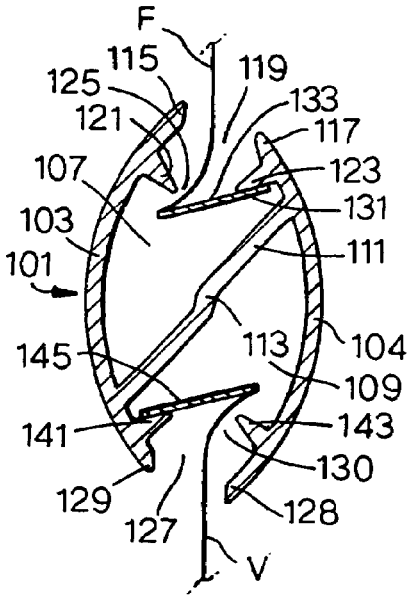
FIGS. 2–4 are widthwise cross-sections of another bottom rail of this invention, showing its profile with upper and lower openings; a blind fabric is shown as being attached to an upper portion of the rail by a stiff marginal edge of the fabric locked under a locking shoulder on a widthwise wall of the rail; in some Figures, a valence fabric is attached to a lower portion of the rail by a stiff marginal edge of the valence fabric, locked under a locking shoulder on another widthwise wall of the rail.

As shown in FIG. 2A, a roller blind fabric F is attached to the upper portion 107 of the rail 101 and a valance fabric V attached to the lower portion 109 of the rail. The stiff marginal edge portion 131 of the blind fabric F, extending through the upper opening 119 of the rail 101, is beneath the rear upper locking shoulder 123 (i.e., between the rear upper locking shoulder 123 and the cross web 111) and engages this shoulder. The gap 125 between the front and rear upper locking shoulders 121,123 and the width of the marginal edge portion 131 of the blind fabric F prevents the marginal edge portion 131 from being pulled vertically out of the rail through the upper opening 119.

The valance fabric V, extending through the lower opening 127 of the rail 101, also has a stiff marginal edge portion 145 which is also locked above the front lower locking shoulder 141 (i.e., between the front lower locking shoulder and the cross web 111) and engages this shoulder. The gap 130 between the front and rear lower locking shoulders 141,143 and the width of the marginal edge portion 145 of the valance fabric V prevents the marginal edge portion 145 from being pulled vertically out of the rail through the lower opening 127.

Figure 2B:
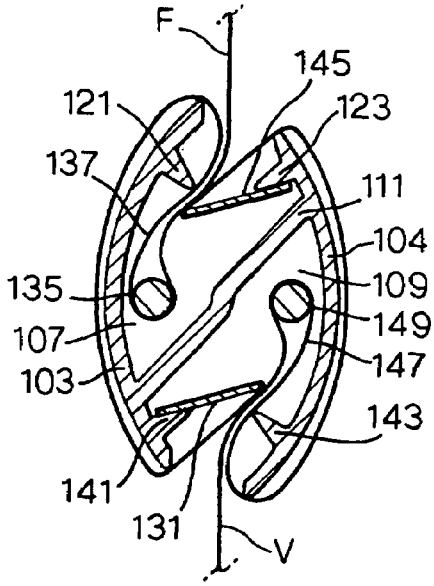

As shown in FIG. 2B, the stiff marginal edge portion 131 of the blind fabric F is locked above the front lower locking shoulder 141 (between the front lower locking shoulder and the cross web 111) and covers the front wall 103. A upper blind fabric fold 137, containing a lengthwise upper spline 135, is provided in the upper portion 107 of the rail's channel 106, beneath the front upper locking shoulder 121 (between the front upper locking shoulder and the cross web 111). The upper spline 135 locks against the blind fabric's stiff marginal edge portion 131 and the upper locking shoulders 121,123.

The valance fabric V is similarly attached to the rail 1 by: locking its stiff marginal edge portion 145 beneath the rear upper locking shoulder 123 (between the rear upper locking shoulder and the cross web 111), and providing a lower valence fabric fold 147, containing a lower lengthwise spline 149, in the lower portion 109 of the channel 106, above the rear lower locking shoulder 143 (between the rear lower locking shoulder and the cross web 111). The lower spline 149 locks against the valence fabric's stiff marginal edge portion 145 and the lower locking shoulders 141, 143.Thereby, the valance fabric V also covers the rear wall 104.

Since the rail 1 is preferably symmetrical, the fabrics F,V can also be attached the other way around, since it would have no visual effect.

FIG. 3A shows the rail 101 with the blind fabric F attached as in FIG. 2B but with no valence fabric V.

FIG. 3B shows the rail 101 with the blind fabric F attached without the use of a stiff marginal edge portion 131. The blind fabric F is attached using only an upper lengthwise spline 135 and a lower lengthwise spline 149. The upper spline 135 lies in an upper blind fabric fold 137 in the upper portion 107 of the rail's channel 106, beneath the upper locking shoulders 121,123 (i.e., between the upper locking shoulders and the cross web 111). The lower spline 149 lies in a lower blind fabric fold 147, in the lower portion 109 of the channel 106, above the lower locking shoulders 141,143 (i.e., between the lower locking shoulders and the cross web 111). The top and bottom gaps 125, 130 are narrower than the two splines 135,149 and thus prevent the blind fabric from being pulled out of the rail 101.

FIG. 4 shows the rail 101, with the blind fabric F attached to it and completely surrounding it as in FIG. 1B. In this regard, the stiff marginal edge portion 131 of the blind fabric F is locked below the rear upper locking shoulder 123 and an upper lengthwise spline 135 is provided in an upper blind fabric fold 137 in the upper portion 107 of the rail's channel 106, beneath the front upper locking shoulder 121. Preferably, a lower lengthwise spline (not shown) is also provided in a lower blind fabric fold 147 in the lower portion 109 of the channel 106, above the lower locking shoulders 141,143. After the blind fabric F is attached to the rail, the lower fold 147 in the blind fabric F is provided in the lower portion 109 of the channel 106. Then, the stiff marginal edge portion 145 of the valance fabric V is inserted, through the bottom opening 127, into the lower portion 109 and above the lower locking shoulders 141,143 (i.e., between the lower locking shoulders and the cross web 111) to hold the valance fabric V, as well as the blind fabric F, on the rail.

Figure 5A:
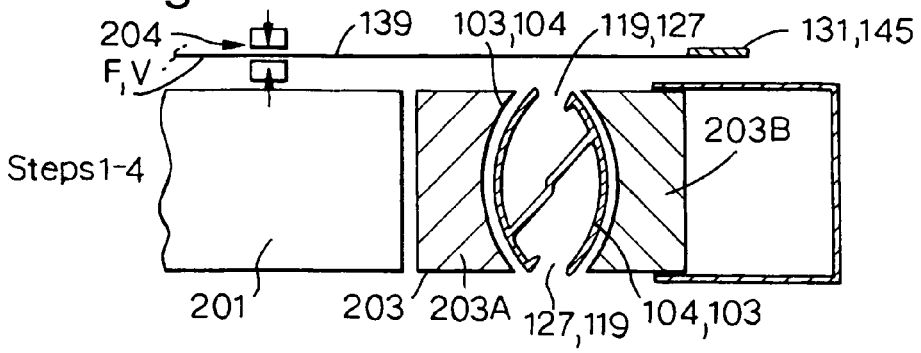
FIGS. 5–7 show schematically various steps in the method of this invention for attaching one or more fabrics to a bottom rail as shown in FIGS. 1–4.

A preferred method for attaching a blind fabric F or a valence fabric V to a rail of this invention is shown schematically in FIGS. 5A–5D by reference to a fabric-rail assembly machine 201. The five steps (1–5) of the method are as follows for making the product of, for example, FIG. 1B from the rail 101:

Step 1. FIG. 5A shows the rail 101 placed in a stationary rail holder 203 of the assembly machine 201. The rail holder 203 preferably includes two longitudinally-extending holder blocks 203A, 203B which have either soft surfaces that contact the opposite sides of the rail's front and rear walls 104,105 or are shaped to mate with the opposite sides of the rail's front and rear walls. The holder blocks 203A,203B can be brought together to grasp and hold the rail 101 between them and can subsequently be separated to release the rail. The holder blocks are adapted to grasp the rail with one of the rail's lengthwise openings 119 or 127 facing upwards and thus accessible from the top of the assembly machine.

Step 2. FIG. 5A also shows the assembly machine 201 with the blind fabric F lain over the rail 101, from one (e.g., left in FIGS. 5–7) widthwise side thereof (i.e., its front) to its other (e.g., right in FIGS. 5–7) widthwise side. As a result, the marginal edge portion 131 of the fabric is placed adjacent the rear wall 104 of the rail 101, and the fabric's remainder 139 overlies the rail, its upward facing opening 119 or 127 and its front wall 103.

Step 3. If the fabric's marginal edge portion 131 is not already stiff, a stiffening strip of plastic or the like can be attached to it or a stiffening agent can be applied to it. In this regard, the stiffening strip can be self-adhesive or a layer of an adhesive can be applied to either the strip or the marginal edge portion 131 before adhering the two together.

Step 4. As further shown in FIG. 5A, a conventional lengthwise retaining means 204 of the assembly machine 201, on the one (left) widthwise side of the rail 101, holds the remainder 139 of the fabric F against unwanted widthwise movement towards the rail's upward facing opening 119 or 127 and toward the other (right) widthwise side of the rail. Preferably, the fabric remainder 139 is also held on the one widthwise side of the rail, between the retaining means 204 and the rail, by a first (i.e., left in FIGS. 5–7) horizontal upper surface, provided with holes (not shown) that are connected to a source of vacuum (not shown). The fabric's marginal edge portion 131 is on the other widthwise side of the rail 101 and is free to move widthwise movement towards the rail's upward facing opening 119 or 127.

Figure 5B:
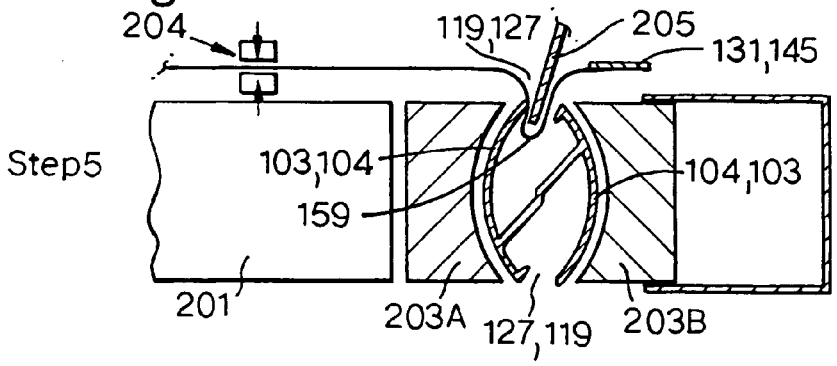
Figure 5C:
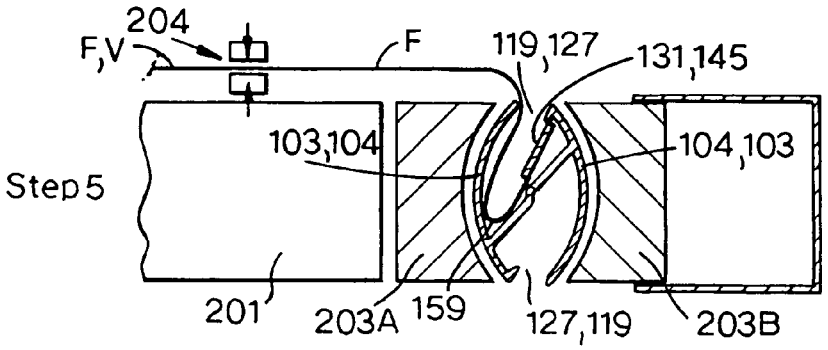

Step 5. FIG. 5B shows a fabric inserting wheel 205 of the assembly machine 201. The wheel 205 can be a conventional fabric inserting wheel, such as is described in U.S. Pat. No. 5,127,143. The circumferential edge of the wheel 205 is rolled, preferably repeatedly, along the length of the rail and over the fabric F where the fabric is directly atop the rail's upward facing opening 119 or 127. Preferably, this rolling passage of the wheel 205 over the fabric and the rail's upward facing opening is in both lengthwise directions. The circumferential edge of the wheel 205 is pressed slightly downwards during each rolling passage over the fabric, so that the wheel enters the rail's upward facing opening, and the circumferential edge of the wheel is preferably pressed further downward in the upward facing opening during each subsequent rolling passage, past the gap 125 or 130 between the adjacent uppermost fabric locking shoulders and preferably down to the cross web 111. Indeed, once the wheel 205 reaches its maximum allowable depth in the rail's channel 106, the assembly machine 201 preferably retracts the wheel. Since only the fabric's remainder 139 is held tight against widthwise movement during this step, the lengthwise passage(s) of the wheel 205 over the upward facing opening 119 or 127 pull the fabric's stiff straight marginal edge portion 131 widthwise towards, and eventually into, the rail's upward facing opening and thereby form a temporary fabric fold 159 in the rail's channel 106, beneath the upward facing opening. Thereafter, repeated rolling passages of the wheel 205 in the upward facing opening push the fabric's marginal edge portion 131 below the uppermost locking shoulders where the marginal edge portion is held between one of the uppermost locking shoulders and the cross web 111 as shown in FIG. 5C. Preferably, the width, flexibility and resilience of the fabric's stiff marginal edge portion 131 cause it to assume a generally U-shaped configuration as the wheel 205 pushes it through the gap 125 or 130 between the uppermost locking shoulders and allows it to become straight again after being pushed through the gap.

Figure 5D:
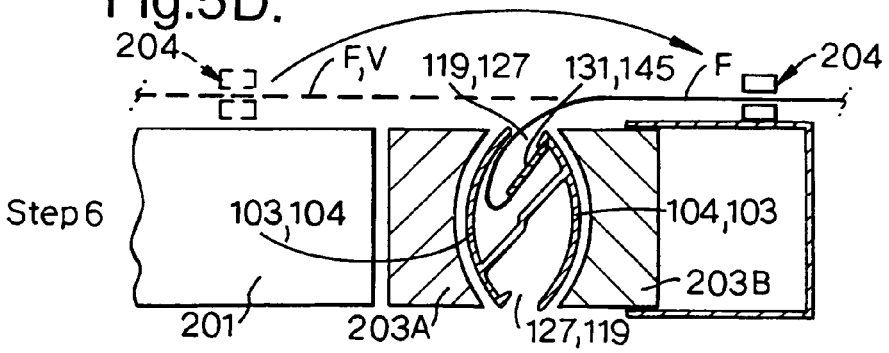
Figure 5E:
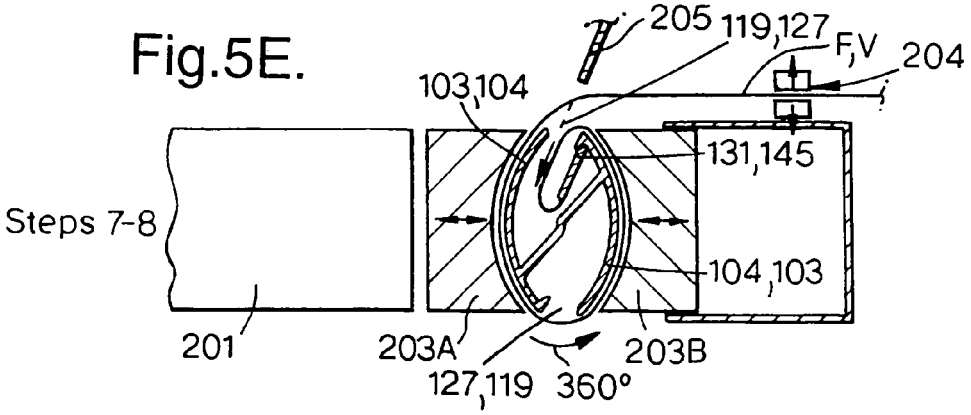
Figure 5F:
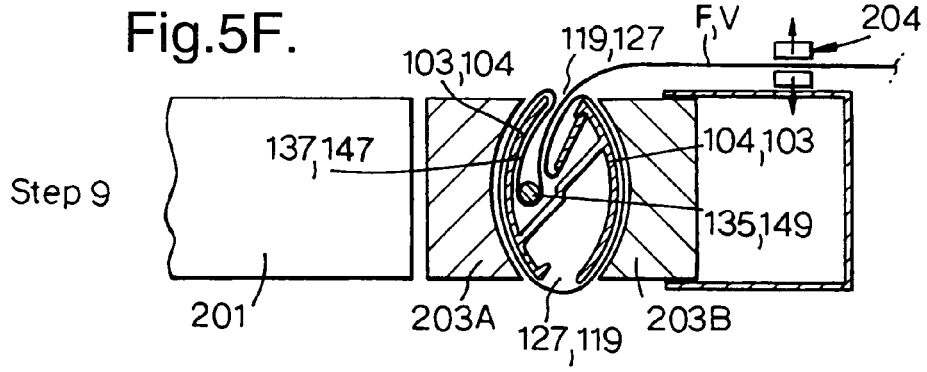

Thereafter, as shown in FIGS. 5D–5F, the remainder 139 of the fabric F can be tightly wrapped about the rail's front and rear walls, 104, 105 as a decorative covering for the rail and also to ensure that the fabric's stiff marginal edge portion 131 is securely held by the locking shoulders. The four steps (6–9) of this method are as follows:

Step 6. As seen in FIG. 5D, the retaining means 204 of the assembly machine 201 carries the fabric remainder 139 from the one (left) widthwise side of the rail 101 to its opposite (right) widthwise side. This is done only after turning off the source of vacuum (not shown) to the holes in the first (left) horizontal upper surface on the one widthwise side of the rail 101. Then, the retaining means 204 holds the fabric remainder 139 on the other (right) widthwise side of the rail against unwanted movement towards the rail's upward facing opening 119 or 127 and the one (left) widthwise side of the rail.

Preferably, the fabric remainder 139 is also then held on the other widthwise side of the rail by a second (i.e., right in FIGS. 5–7) horizontal upper surface, which is on the other (right) widthwise side of the rail, between the first retaining means 204 and the rail, and which has holes (not shown), connected to a source of vacuum (not shown).

Step 7. As shown in FIG. 5E, the rail holder 203 slightly releases the ends of the rail 101 by sliding apart the holder blocks 203A,203B. At the same time, the retaining means 204 releases somewhat its grip on the remainder 139 of the fabric F. The rail is then rotated 360 degrees in the direction away from the retaining means 204, causing the fabric remainder 139 to be wrapped completely around the rail and overlie its originally upward facing opening 119 or 127 (which is again upward facing in FIG. 5E).

Step 8. As also shown in FIG. 5E, the wheel 205 again rolls, preferably repeatedly, along the length of the rail 101 over the fabric F where it is directly atop the rail's upward facing opening 119 or 127. As in step 5 (FIGS. 5B and 5C), a fabric fold 137 or 147 is formed in the rail's channel 106, beneath the upward facing opening, because the retaining means 204, on the opposite (right) widthwise side of the rail, allows controlled movement of the fabric remainder 139 towards the rail's upward facing opening 119 or 127 and the one (left) widthwise side of the rail.

Step 9. As shown in FIG. 5F, the fabric fold 137 or 147 is secured inside the channel 106, beneath the upward facing opening 119 or 127, by a lengthwise spline 135 or 149 which is preferably wider than the adjacent gap 125 or 130 between the adjacent locking shoulders, above the fabric loop and the spline. The spline is preferably inserted longitudinally from an open end (not shown) of the rail, adjacent to one of the holder blocks 203A,203B. The spline 135 or 149 lies within the fabric fold 137 or 147. When the fabric remainder 139 is pulled taught, the spline locks against the fabric's stiff marginal edge portion 131 and the locking shoulders beneath the upward facing opening.

Figure 6A:
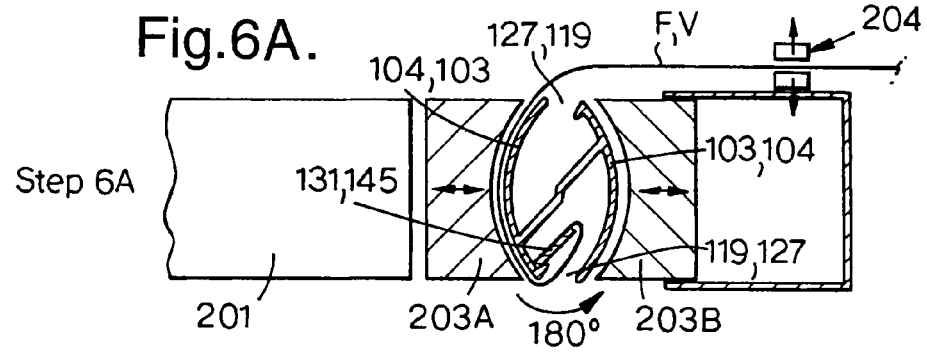

The product of FIG. 2A (where a blind fabric F is attached to the top of a rail 101 and a valance fabric V is attached to the bottom of the rail) can be made by steps 1–6, above (FIGS. 5A–5D), followed by steps 6A and 6B, as follows:

Step 6A As shown in FIG. 6A, with the retaining means 204 of the assembly machine 201 holding the remainder 139 of a blind fabric F on the opposite (right) widthwise side of the rail 101, the rail is rotated over 180 degrees in the direction away from the retaining means 204 and the fabric remainder 139.

Figure 6B:
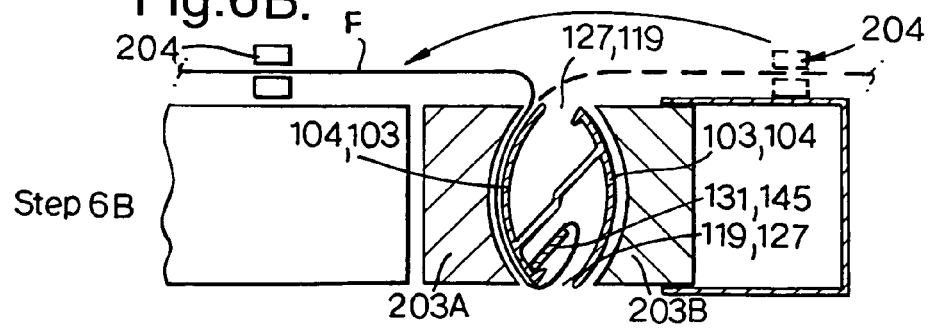

Step 6B As shown in FIG. 6B, the retaining means 204 carries the fabric remainder 139 back to the one (left) widthwise side of the rail 101, so that the remainder no longer covers the rail's upward facing opening 119 or 127. This is done only after turning off the source of vacuum (not shown) to the second horizontal upper surface on the opposite (right) widthwise side of the rail 101. Preferably, the retaining means 204 then holds the fabric remainder 139 on the one (left) widthwise side of the rail against unwanted movement towards the rail's upward facing opening 119 or 127 and the other (right) widthwise side of the rail. The holes in the first horizontal upper surface, on the one (left) widthwise side of the rail, are then connected to the source of vacuum (not shown).

Thereafter, steps 2–6 (FIGS. 5A–5D) are repeated using a valence fabric V after rotating the rail 101 by 180 degrees, so that its other opening 127 or 119 faces upward.

The product of FIG. 3A (where a blind fabric F is attached to the top of a rail 101 and covers its front wall 103) can be made by steps 1–6, above (FIGS. 5A–5D), followed by step 6A (FIG. 6A) and then steps 8–9, above (FIGS. 5E–5F).

Figure 7A:
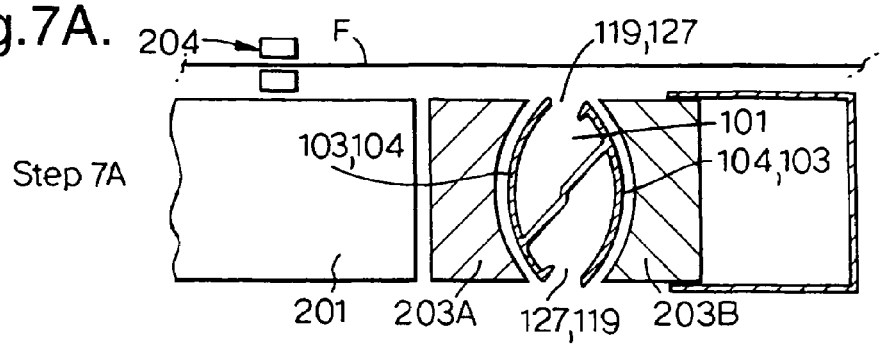

The product of FIG. 3B (where a blind fabric F, without a stiff straight marginal edge portion, is attached to the top and bottom of a rail 101 and covers its front wall 103) can be made by steps 7A–7D (FIGS. 7A–7D) as follows:

Step 7A. As shown in FIG. 7A, the rail 101 is placed in the stationary rail holder 203 of the assembly machine 201. The fabric F is then laid over the rail and its upward facing opening 119,127, so that on each of its widthwise sides, there is enough of a fabric width, so that it will not all be pushed into the rail by the fabric inserting wheel 205 of this invention. The first retaining means 204, on the one (left) widthwise side of the rail and preferably the first horizontal surface, the holes in the upper surface of which are connected to a source of vacuum, hold the width of fabric on its one widthwise side against unwanted movement towards the rail's upward facing opening 119 or 127 and toward its other (right) widthwise side.

Figure 7B:
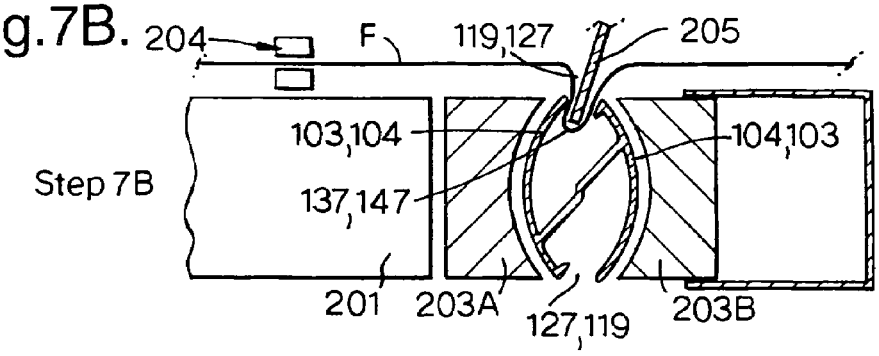

Step 7B. As shown in FIG. 7B, the fabric inserting wheel 205 passes, preferably repeatedly, along the length of the rail 101 and over the fabric F where the fabric is directly atop the rail's upward facing opening 119 or 127, thereby forming a fabric fold 137,147 in the rail's channel 106, beneath the upward facing opening.

Figure 7C:
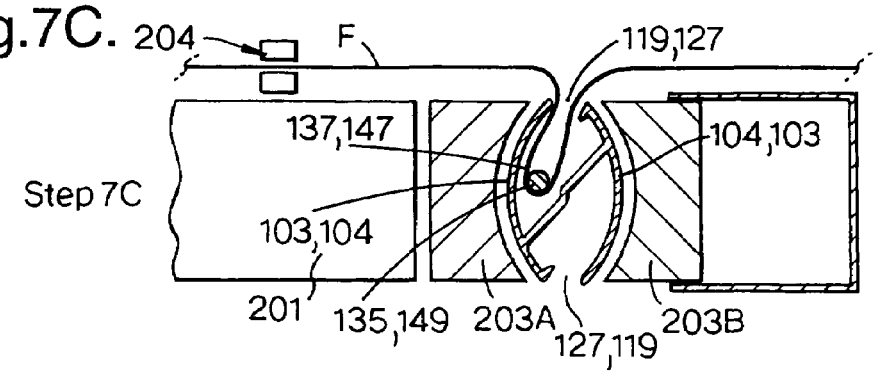

Step 7C. As shown in FIG. 7C, a lengthwise spline 135,149 is inserted in one end of the rail 101 and into the fabric fold 137,147.

Figure 7D:
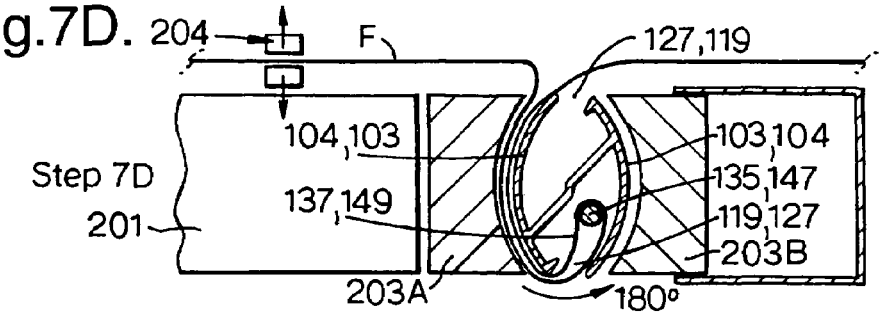

Step 7D As shown in FIG. 7D, the rail is rotated over 180 degrees, and steps 7B and 7C, above, are then repeated.

The product of FIG. 2B (where a blind fabric F is attached to the top of a rail 101 and covers its front wall 104 and a valence fabric V is attached to the bottom of the rail 101 and covers its rear wall 105) can be made by: first making the product of FIG. 3A from the blind fabric F by steps 1–6, above (FIGS. 5A–5D), step 6A (FIG. 6A), above, and then steps 8–9, above (FIGS. 5E–5F); then step 6B (FIG. 6B), above; and then repeating steps 1–6, above (FIGS. 5A–5D), step 6A (FIG. 6A), above, and then steps 8–9, above (FIGS. 5E–5F) with the valence fabric V, instead of the blind fabric F.

This invention is, of course, not limited to the above-described embodiments which may be modified without departing from the scope of the invention or sacrificing all of its advantages. In this regard, the terms in the foregoing description and the following claims, such as "lengthwise", "widthwise", "upwardly", "uppermost", "downwardly", "vertically", "horizontally", "upper", "lower", "left", "right", "top" and "bottom", have been used only as relative terms to describe the relationships of the various elements of the rail of the invention for fabric coverings for architectural openings.

For example, the fabric inserting wheel 205 of the assembly machine 201 need be rolled only once or a few times along the length of the rail over the fabric F and the rail's upward facing opening 19,119 or 127 while being pressed downwards in step 5 (FIG. 5B) and step 8 (FIG. 5E), above, but this would require a fabric inserting wheel of relatively large diameter which would tend to stress the fabric F, V being attached to the rail 1,101. By comparison, the fabric inserting wheel 205 can have a significantly smaller diameter and will not tend to stress the fabric being attached to the rail, provided it is repeatedly rolled along the length of the rail over the fabric and the upward facing opening while being pressed downwards in steps 5 and 8.

Likewise, pairs of fabric locking shoulders 21,23,121, 123, 141,143 on opposite widthwise sides of each of the upper and lower portions 7,9, 107,109 of the channel 6,106 of the rail 1,101 are preferred, but only one such shoulder is needed in each of the upper and lower portions of the rail's channel.

What is claimed is:

1. An elongate hollow rail for a fabric covering for an architectural opening having an upper portion with a lengthwise upper opening in the top of the rail and being characterized by:

a pair of walls on widthwise sides of said rail having inner surfaces, said inner surfaces of said walls being interconnected by a cross web;

a pair of lengthwise upper locking shoulders projecting inwardly respectively from said inner surfaces of the upper portion of said walls on opposite widthwise sides of the upper opening such that the inner surface of the walls extends above and below the locking shoulders;

the upper locking shoulders being wedge-shaped and pointing inwardly of the upper portion and away from the upper opening; and the wall on a first widthwise side of the bottom rail extending above the wall on the opposite second widthwise side of the bottom rail about the opening when the walls are substantially vertically oriented.

2. The rail of claim 1 which also has a lower portion with a lengthwise lower opening in the bottom of the rail and is characterized by:

a pair of lengthwise lower locking shoulders respectively projecting inwardly from said inner surfaces of the lower portion of said walls on opposite widthwise sides of the lower opening;

the lower locking shoulders being wedge-shaped and pointing inwardly of the lower portion and away from the lower opening; and the wall on the other widthwise side of the bottom rail extending below the wall on the first widthwise side of the bottom rail about the lower opening when the walls are substantially vertically oriented.

3. The rail of claim 2 wherein:

the cross web is tilted widthwise so as to intercept one of said walls at a higher elevation than the other of said walls; and opposite widthwise sides of the cross web being parallel but not coplanar.

4. A method for attaching a fabric to a locking shoulder within an elongate hollow rail for a fabric covering for an architectural opening wherein the rail has a lengthwise upper opening in an upper portion defined between two walls, by the steps of:

securing the rail with its lengthwise upper opening facing upwards;

overlaying the rail and its upper opening and walls with a fabric having a stiff straight marginal edge, so that the stiff marginal edge lies parallel and adjacent to a wall on a widthwise side of the rail and the remainder of the fabric extends widthwise away from the stiff marginal edge and the rail and its other wall;

pushing the fabric into the upper opening by rolling the circumferential edge of a fabric inserting wheel against the top of the fabric and lengthwise along, and inwardly of, the upper opening while allowing the stiff marginal edge to move widthwise towards the upper opening but preventing the remainder of the fabric from moving widthwise towards the upper opening; and then pushing the stiff marginal edge into the upper opening so that the marginal edge engages the locking shoulder by again rolling the fabric inserting wheel against the top of the fabric end lengthwise along, and inwardly of, the upper opening while preventing the remainder of the fabric from moving widthwise towards the upper opening.

5. A method for attaching a fabric to a locking shoulder within an elongate hollow rail for a fabric covering for an architectural opening having a lengthwise upper opening in an upper portion of the rail, defined between two walls by the steps of:

securing the rail with its lengthwise upper opening facing upwards;

overlaying the rail and its upper opening and walls with a fabric having a stiff straight marginal edge, so that the stiff marginal edge lies parallel and adjacent to a wall on a widthwise side of the rail and the remainder of the fabric extends widthwise away from the stiff marginal edge and the rail and its other wall;

pushing the fabric into the upper opening by rolling the circumferential edge of a fabric inserting wheel against the top of the fabric and lengthwise along, and inwardly of, the upper opening while allowing the stiff marginal edge to move widthwise towards the upper opening but preventing the remainder of the fabric from moving widthwise towards the upper opening; and then pushing the stiff marginal edge into the upper opening so that the marginal edge engages the locking shoulder by again rolling the fabric inserting wheel against the top of the fabric and lengthwise along, and inwardly of, the upper opening while preventing the remainder of the fabric from moving widthwise towards the upper opening.

6. The method of claim 5 for also covering one wall of the rail with the fabric where a lower portion of the rail has a lengthwise lower opening, by the steps of:

rotating the rail in a direction such that the stiff marginal edge of the fabric is not disengaged from the locking shoulder and until the lengthwise lower opening faces upwards, the fabric covers the one wall and overlies the rail and its lower opening and the other wall, and the remainder of the fabric extends widthwise away from the rail and the other wall; and then pushing the fabric into the lower opening to form a first fold in the lower portion by rolling the circumferential edge of the fabric inserting wheel against the top of the fabric arid lengthwise along, and inwardly of, the lower opening while allowing the remainder of the fabric to move widthwise towards the lower opening: and then inserting, in a lengthwise direction, a elongate first spline into the first fold.

7. The method of claim 6 for covering the other wall of the rail with the fabric by:

again rotating the rail in a direction such that the stiff marginal edge of the fabric is not disengaged from the locking shoulder and until its lengthwise upper opening faces upwards, the fabric covers the other wall and overlies the rail and its upper opening and the one wall, and the remainder of the fabric extends widthwise away from the rail and the one wall; and then pushing the fabric into the upper opening to form a second fold in the upper portion by rolling the circumferential edge of the fabric inserting wheel against the top of the fabric and lengthwise along, and inwardly of, the upper opening while allowing the remainder of the fabric to move widthwise towards the upper opening; and then inserting, in a lengthwise direction, a elongate second spline into the second fold.

8. The method of claim 5 wherein the circumferential edge of the wheel is repeatedly rolled along, and inwardly of, the upper and/or lower openings of the rail.

9. The method of claim 8 wherein the circumferential edge of the wheel is repeatedly rolled along, and inwardly of, the upper and/or lower openings of the rail in both lengthwise directions.

10. The method of claim 5 wherein a roller blind fabric is attached to an upper opening of the rail and a valance fabric is attached to a bottom opening of the rail.

11. A method of attaching a fabric to a hollow rail profile, the fabric comprising a sheet portion and a longitudinal end portion with a stiffening member attached thereto, the rail profile having a longitudinally extending fabric receiving opening out into a first or upper longitudinal extending fabric mounting opening between a first profile wall and an opposite second profile well, the first profile wall having a longitudinally extending inwardly directed fabric locking shoulder adjacent the opening, the method comprising the steps of, securing the profile with the first fabric mounting opening facing upwards, overlaying the profile and its first opening with the fabric, so that the stiffening member of the longitudinal end portion lies parallel and adjacent to the first profile wall and the sheet portion of the fabric extends horizontally away from the stiffening member over the profile and the first fabric mounting opening, applying a fabric inserting wheel on a movable carriage for rolling the fabric into the first fabric mounting opening, and rolling the stiffening member into the first opening by at least one longitudinally directed rolling pass of the fabric inserting wheel.

12. The method of claim 11 wherein the method, after the stiffening member is rolled into the first fabric mounting opening, further comprising the steps of:

folding the sheet portion back over the profile and pulling it tight, thereby lodging the stiffening member under a first longitudinally extending locking flange extending inward from the first profile wall, releasing the profile rail and turning it over 360 degrees and re-securing it to the support structure thus covering the profile with fabric, and locating the first fabric mounting opening facing upwards with the fabric extending over it, re-applying the fabric inserting wheel on a movable carriage for rolling a first spline fold of the fabric sheet portion into the first fabric mounting opening.

13. The method of claim 12, further comprising the step of, inserting a splining member into the profile, such that the spline lies into the first spline fold that is rolled into the profile, the spline preventing the fabric from being pulled out through the fabric inserting opening.

14. The method of claim 11 wherein the stiffening member is formed in situ on the longitudinal end portion of the fabric material.

15. A rail profile, to which a fabric can be mounted using the method of claim 11, wherein the rail profile comprises a body having an interior longitudinally extending fabric receiving space opening out into a first longitudinal extending fabric mounting entrance opening between a first profile wall and an opposite second profile wall, the first profile wall having a longitudinally extending inwardly directed fabric locking shoulder adjacent the opening; and characterised in that:

the width of the elongated opening is bigger than the lateral width of the wheel for rolling in the fabric;

the fabric receiving space extends sufficiently in a generally downward direction for accommodating the wheel in its action of rolling in the fabric; and the lateral inwardly extending locking shoulder is sufficiently wide to prevent the stiffening member on the fabric from being pulled away from the locking shoulder.

16. A method of mounting a fabric to a hollow rail profile, the fabric comprising a sheet portion and a longitudinal end portion with a stiffening member attached thereto, the rail profile comprising a first longitudinal extending fabric mounting opening between a first profile wall and an opposite second profile wall and a second longitudinal extending fabric mounting opening, the first and second fabric openings being separated by an intermediate web member, the method comprising the steps of, securing the profile with the first fabric mounting opening facing upwards, overlaying the profile and its first opening with the fabric, so that the stiffening member of the longitudinal end portion lies parallel and adjacent to the first profile wall and the sheet portion of the fabric extends horizontally away from the stiffening member over the profile and the first fabric mounting opening, applying a fabric inserting wheel on a movable carriage for rolling the fabric into the first fabric mounting opening, and rolling the stiffening member into the first opening by at least one longitudinally directed rolling pass of the fabric inserting wheel.

17. The method of claim 16 wherein the method after the stiffening member is rolled into the first fabric mounting opening, further comprising the steps of:

folding the sheet portion back over the profile and pulling it tight, thereby logding the stiffening member under a first longitudinally extending locking flange extending inward from the first profile wall, releasing the profile rail and turning it over 180 degrees and re-securing it, thus covering the first profile wall with fabric end locating the second fabric mounting opening facing upwards with the fabric extending over it, re-applying the fabric inserting wheel on a movable carriage for rolling a first spline fold of the fabric sheet portion into the second fabric mounting opening, and inserting a spline into the profile, such that the spline lies into the first spline fold that is rolled info the profile, the spline preventing the fabric from being pulled out through the fabric inserting opening.

18. The method of claim 16 wherein the method, after the stiffening member is rolled into the first fabric mounting opening, further comprises the steps of:

folding the sheet portion back over the profile and pulling it tight, thereby logding the stiffening member under a first longitudinally extending locking flange extending inward from the first profile wall, releasing the profile rail and turning it over 360 degrees and re-securing it, thus covering the profile with fabric, and locating the first fabric mounting opening facing upwards with the fabric extending over it, re-applying the fabric inserting wheel on a movable carriage for rolling a first spline fold of the fabric sheet portion into the first fabric mounting opening, and inserting a spline into the profile, such that the spline lies into the first spline fold that s rolled into the profile, the spline preventing the fabric from being pulled out through the fabric inserting opening.

19. The method of claim 18 wherein a second fabric is mounted to the profile, the second fabric comprising a valance sheet and longitudinal extending valance end portion with a valance stiffening edge, by the following additional method steps;

locating and securing the profile rail such that the second fabric mounting opening which is covered by fabric faces upward, overlaying the profile and its covered second fabric mounting opening with the second fabric, so that the valance stiffening member of the longitudinal end portion lies parallel and adjacent to the first profile wall and the sheet portion of the fabric extends horizontally away from the stiffening member over the profile and the first fabric mounting opening, re-applying the fabric inserting wheel on the movable carriage for rolling the valance stiffening member into the second fabric mounting opening and at the same time rolling a second spline fold of the fabric sheet portion into the second fabric mounting opening.

20. The method of claim 16 wherein a second fabric is mounted to the profile, the second fabric comprising a valance sheet and longitudinal extending valance end portion with a valance stiffening edge, by the following additional method steps;

locating and securing the profile rail such that the second fabric mounting opening faces upward, overlaying the profile and its second fabric mounting opening with the second fabric, so that the valance stiffening member of the longitudinal end portion lies parallel end adjacent to the second profile wall and the valance sheet extends horizontally away from the valance stiffening member over the profile and the second fabric mounting opening, re-applying the fabric inserting wheel on the movable carriage for rolling the valance stiffening member into the second fabric mounting opening.

21. The method of claim 16 wherein a second fabric is mounted to the profile, the second fabric comprising a valance sheet and longitudinal extending valance end portion with a valance stiffening edge, by the following additional method steps;

locating and securing the profile rail such that the second fabric mounting opening faces upward, overlaying the profile and its second fabric mounting opening with the second fabric, so that the valance stiffening member of the longitudinal end portion lies parallel and adjacent to the second profile wall and the valance sheet extends horizontally away from the valance stiffening member over the profile and the second fabric mounting opening, re-applying the fabric inserting wheel on the movable carriage for rolling the valance stiffening member into the second fabric mounting opening;

folding the valence sheet portion back over the profile and pulling it tight, thereby logding the valance stiffening member under a second longitudinally extending locking flange extending inward from the second profile wall, releasing the profile rail and turning it over 180 degrees and re-securing it to the support structure, thus covering the second profile wall with valance fabric and locating the first fabric mounting opening facing upwards with the second fabric extending over it, re-applying the fabric inserting wheel on a movable carriage for rolling a second spline fold of valance fabric sheet portion into the first fabric mounting opening, and inserting a valance spline into the profile, such that the valance spline lies into the second spline fold that is rolled into the profile, the valance spline preventing the second fabric from being pulled out through the first fabric inserting opening.

22. A method of mounting a fabric to a hollow rail profile, the fabric comprising a sheet portion and a longitudinal end portion, the rail profile comprising a first longitudinal extending fabric mounting opening between a first profile wall and an opposite second profile wall and a second longitudinal extending fabric mounting opening, the first and second fabric openings being separated by an intermediate web member, the method comprising the steps of, securing the profile with the first fabric mounting opening facing upwards, overlaying the profile and its first opening with the fabric, so that the end portion lies parallel and adjacent to the first profile wall and the sheet portion of the fabric extends horizontally away from the end portion over the profile and the first fabric mounting opening, applying a fabric inserting wheel on a movable carriage for rolling a first fabric fold into the first fabric mounting opening, and inserting a spline into the profile, such that the spline lies into the first fabric fold that is rolled into the profile, the spline preventing the fabric from being pulled out through the fabric inserting opening, releasing the profile rail and turning it over 180 degrees and re-securing it to the support structure, thus covering the first profile wall with fabric and locating the second fabric mounting opening facing upwards with the fabric extending over it, re-applying the fabric inserting wheel on a movable carriage for rolling a second spline told of the fabric sheet portion into the second fabric mounting opening, and inserting a second spline into the profile, such that the spline lies into the second spline fold that is rolled into the profile, the spline preventing the fabric from being pulled out through the fabric inserting opening.

23. An apparatus for attaching a fabric to an elongate hollow rail for a fabric covering for an architectural opening comprising mechanical means for carrying out the steps of the method of claim 5.

* * * * *

UNITED STATES PATENT AND TRADEMARK OFFICE

CERTIFICATE OF CORRECTION

PATENT NO. : 6,978,821 B2
APPLICATION NO. : 10/624425
DATED : December 27, 2005
INVENTOR(S) : Konrad Welfonder It is certified that error appears in the above-identified patent and that said Letters Patent is hereby corrected as shown below:

(claim 4) Column 12, line 1 delete "end" and insert --and--;
and
(claim 5) Column 12, in line 6, after "rail" insert --according to claim 1--.

Signed and Sealed this

Nineteenth Day of January, 2010

David J. Kappos

David J. Kappos
*Director of the United States Patent and Trademark Office*